US006206590B1

(12) United States Patent
Thomas et al.

(10) Patent No.: US 6,206,590 B1
(45) Date of Patent: Mar. 27, 2001

(54) LABEL PRINTING ASSEMBLY FOR USE WITH A MEDICAMENT DISPENSING CONTROL WORKSTATION

(75) Inventors: Tracy I. Thomas, Overland Park; Keith W. Kudera, Merriam; Lawrence E. Guerp, Roeland Park, all of KS (US)

(73) Assignee: Scripto LLC, Mission, KS (US)

( * ) Notice: Subject to any disclaimer, the term of this patent is extended or adjusted under 35 U.S.C. 154(b) by 0 days.

(21) Appl. No.: 09/538,374

(22) Filed: Mar. 29, 2000

Related U.S. Application Data

(60) Provisional application No. 60/128,429, filed on Apr. 5, 1999.

(51) Int. Cl.[7] ..... B41J 11/48

(52) U.S. Cl. ..... 400/586; 400/611; 221/2; 221/7

(58) Field of Search ..... 400/586, 611, 400/613, 615.2; 156/361, 362, 363, 364; 221/2, 6, 7, 135, 172, 183, 220; 700/235; 705/2

(56) References Cited

U.S. PATENT DOCUMENTS

| | | | | |
|---|---|---|---|---|
| 1,128,561 | | 2/1915 | Webendorfer | 453/35 |
| 2,690,856 | | 10/1954 | Trondle | 221/183 |
| 3,746,211 | | 7/1973 | Burgess, Jr. | 221/7 |
| 4,264,396 | * | 4/1981 | Stewart | 156/361 |
| 4,284,301 | | 8/1981 | Geiger et al. | 294/104 |
| 4,386,860 | * | 6/1983 | Price et al. | 400/124 |
| 4,660,824 | | 4/1987 | Hermkens et al. | 271/208 |
| 4,753,473 | | 6/1988 | Arnett | 294/104 |
| 4,810,230 | | 3/1989 | Shirasawa | 453/57 |
| 4,872,803 | | 10/1989 | Asakawa | 414/730 |
| 4,902,263 | | 2/1990 | Ito et al. | 453/49 |
| 4,918,604 | * | 4/1990 | Baum | 221/5 |
| 5,082,268 | | 1/1992 | Santoro | 271/14 |
| 5,332,275 | | 7/1994 | Conway et al. | 294/100 |
| 5,337,919 | | 8/1994 | Spaulding et al. | 221/2 |
| 5,713,487 | | 2/1998 | Coughlin | 221/2 |
| 5,718,525 | * | 2/1998 | Bruhnke et al. | 400/586 |
| 5,762,235 | | 6/1998 | Coughlin | 221/6 |
| 5,798,020 | | 8/1998 | Coughlin et al. | 156/542 |
| 5,860,563 | | 1/1999 | Guerra et al. | 221/172 |
| 5,873,488 | | 2/1999 | Guerra | 221/220 |
| 5,897,024 | | 4/1999 | Coughlin et al. | 221/135 |

FOREIGN PATENT DOCUMENTS

| | | |
|---|---|---|
| 53-145260 | 12/1978 | (JP) . |
| 59-43743 | 10/1984 | (JP) . |
| 918086 | 4/1982 | (SD) . |

* cited by examiner

*Primary Examiner*—John S. Hilten
*Assistant Examiner*—Minh H. Chau
(74) *Attorney, Agent, or Firm*—Hovey Williams Timmons & Collins

(57) ABSTRACT

A label printing assembly (10) that effectively eliminates labeling errors caused by pharmacists placing the wrong prescription labels on medicine vials or packages. The label printing assembly is preferably configured for use with an automated medicament dispensing control workstation (11) and broadly includes a label print head (12), a label supply assembly (14), a label peeler assembly (16), and a control assembly (18).

10 Claims, 4 Drawing Sheets

LABEL PRINTING ASSEMBLY FOR USE WITH A MEDICAMENT DISPENSING CONTROL WORKSTATION

RELATED APPLICATIONS

This application claims the priority benefit of provisional application entitled Medicament Dispensing Control Workstation, Ser. No. 60/128,429, filed Apr. 5, 1999, incorporated into the present application by reference. The application also relates to co-pending patent application entitled Automatic Dispensing System for Unit Medicament Packages, Ser. No. 09/457,286, filed Dec. 8, 1999, and co-pending patent application entitled Medicament Dispensing Control Workstation, Ser. No. 09/538,442, filed Mar. 29, 2000, both hereby incorporated into the present application by reference.

BACKGROUND OF THE INVENTION

1. Field of the Invention

The present invention relates to label printing assemblies. More particularly, the invention relates to a label printing assembly for use with a medicament dispensing control workstation used for filling and dispensing medicaments such as prescription drugs.

2. Description of the Prior Art

Label printers are commonly used in pharmacies for printing prescription labels that are then placed on medicine vials or other medicament packaging to instruct a patient on the proper use of a medicament. In pharmacies where prescriptions are manually filled and dispensed, it is common for pharmacists to pre-print prescription labels for numerous different prescriptions and to later sort through and apply the preprinted labels to the appropriate vials or packages. Unfortunately, this practice often causes pharmacists to place the wrong label on a vial or package and to therefore dispense the wrong medicament to a patient, possibly causing serious illness or even death.

OBJECTS AND SUMMARY OF THE INVENTION

The present invention solves the above-described problems and provides a distinct advance in the art of label printers used for printing prescription labels. More particularly, the present invention provides a label printing assembly that effectively eliminates labeling errors caused by pharmacists placing the wrong prescription labels on medicine vials or packages.

The label printing assembly of the present invention is preferably configured for use with an automated medicament dispensing control workstation and broadly includes a label print head, a label supply assembly, a label peeler assembly, and a control assembly. The label supply assembly transports a supply of blank labels carried on a release layer to the label print head for printing label information on the blank labels. The label peeler assembly partially separates printed labels from their release layer so that a pharmacist or other operator can remove the printed labels from the label printing assembly using one hand and place them directly on medicine vials or packages.

This control assembly eliminates mislabeling errors because it allows the operator to place the label on the medicine vial or package immediately after the label has been printed and without intervening steps such as peeling the label off the release layer or sorting through a pile of labels to retrieve the correct one. Both of the intervening steps mentioned often require the operator to use both hands, therefore they often involve the operating putting the vial or package down on the counter to free both hands to conduct these steps. When the operator must again retrieve the correct medication from the counter to resume labeling, the chances for errors are increased. Therefore, eliminating these intervening steps, as the control assembly does, reduces errors in the pharmacy.

The control assembly eliminates mislabeling errors by preventing a pharmacist or other operator from retrieving printed labels under certain circumstances. For example, the control assembly may be configured to discard or otherwise prevent access to a printed label in the label printing assembly. This prevents an operator from pre-printing numerous prescription labels and then attempting to locate the proper label for a vial or a package from a pile of pre-printed labels. The control assembly may also be configured to discard or otherwise prevent access to a printed label if the operator or someone else attempts to print a new label before removing the existing printed label. Once again, this prevents a pharmacist from pre-printing numerous prescription labels before each label is removed from the label printing assembly and applied to the proper medicine vial or package.

The assembly also prevents an operator from pre-printing numerous labels because the labels are completely removed from the release layer when the operator removes them from the control assembly, and the label will not perform well if applied to an interim location and then removed. Therefore, when the labels are removed from the assembly, they are applied directly to the final location, the vial or package.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
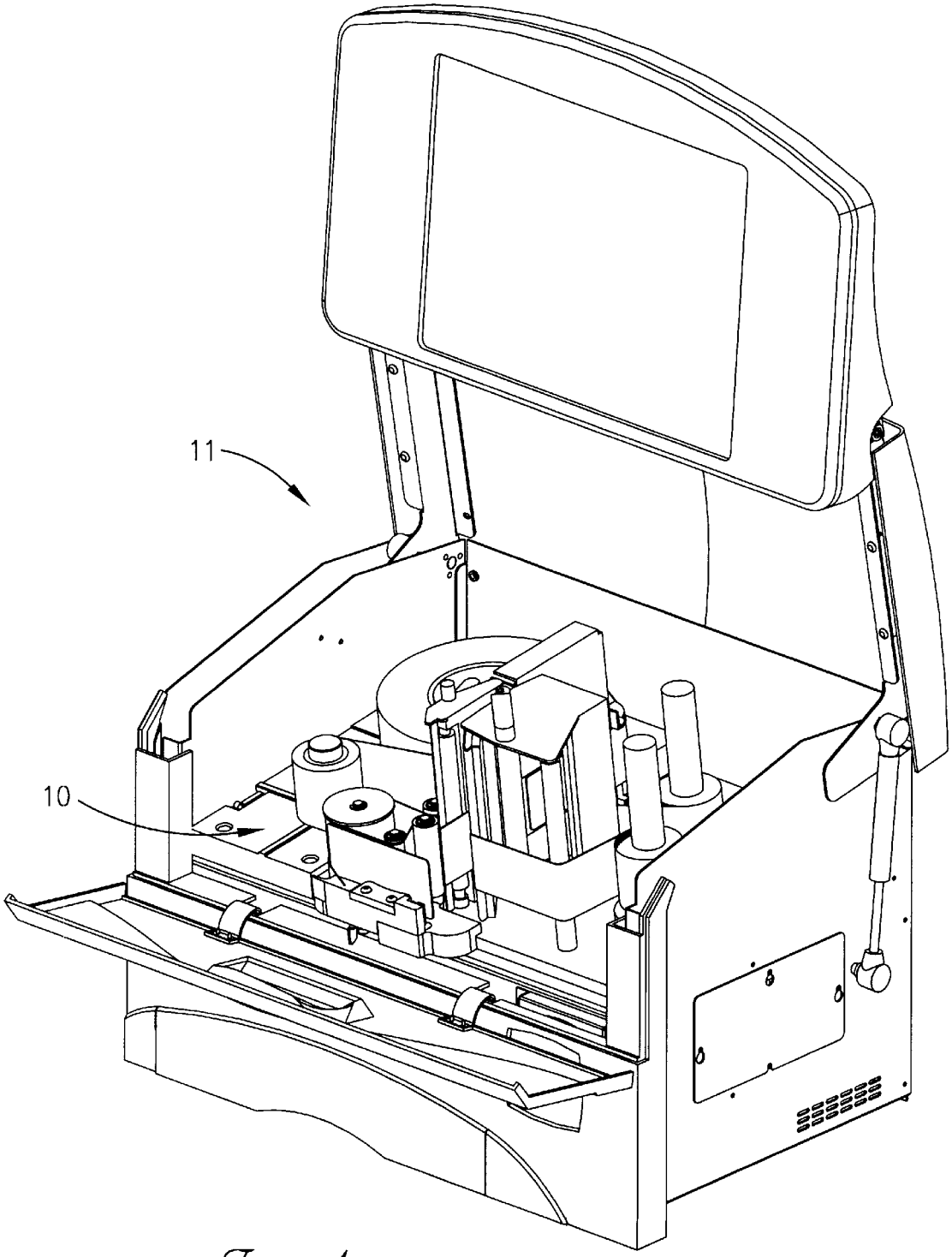
FIG. 1 is an isometric view of a label printing assembly constructed in accordance with a preferred embodiment of the present invention and shown in use with a medicament dispensing workstation.
Figure 2:
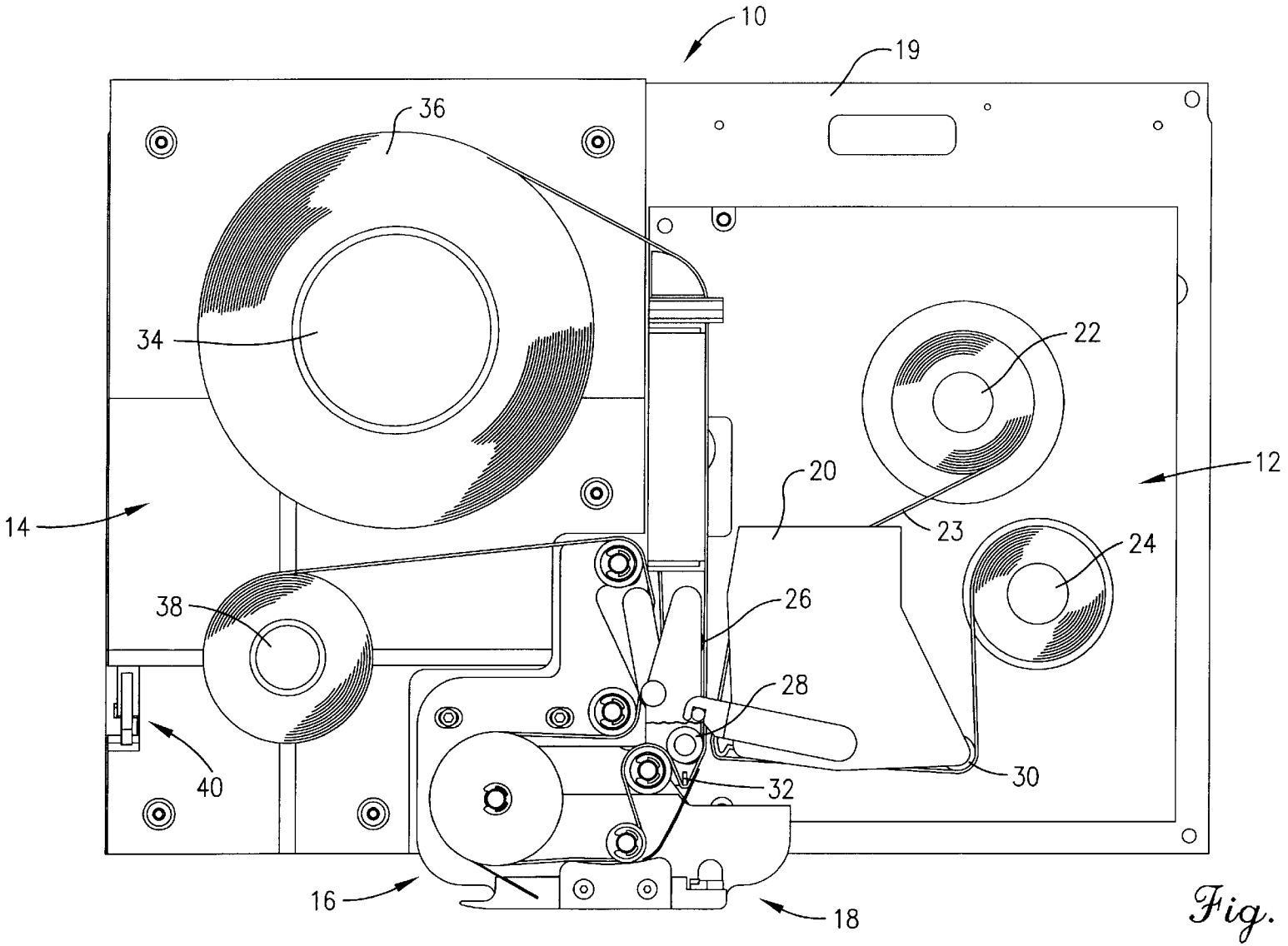
FIG. 2 is a plan view of the label printing assembly shown removed from the workstation.

Turning now to the drawing figures, and particularly FIG. 2, a label printing assembly 10 constructed in accordance with a preferred embodiment of the invention is illustrated. The label printing assembly is preferably configured for use in a medicament dispensing control workstation 11 as illustrated in FIG. 1. The workstation is described in more detail in co-pending patent application entitled Medicament Dispensing Control Workstation, Ser. No. 09/538,442, filed Mar. 29, 2000, hereby incorporated into the present application by reference. The workstation and the label printing assembly of the present invention may be used together as a stand-alone device or may be used in conjunction with an automatic medicament dispensing system such as the SP 200 manufactured and sold by ScriptPro LLC of Mission, Kans. or the automatic medicament storing and dispensing apparatus described in co-pending patent application entitled Automatic Dispensing System for Unit Medicament Packages, Ser. No. 09/457,286, filed Dec. 8, 1999, also incorporated into the present application by reference.

Returning to FIG. 2, the label printing assembly 10 broadly includes a label printer 12, a label supply assembly 14, a label peeler assembly 16, and a control assembly 18. Each of these assemblies, except for certain components of the control assembly, are preferably mounted to a support plate 19 that can be easily placed in and removed from the workstation housing.

In more detail, the label printer 12 is mostly conventional and is preferably a model number M8485 printer manufactured by SATO Corporation of Japan. The printer includes a print head 20, a ribbon feed spool 22 for holding a supply of printer ribbon 23, and a ribbon take-up spool 24 for advancing the ribbon from the ribbon feed spool through the print head and for then holding the used printing ribbon after it passes out of the print head. The printer also includes a number of rollers 26, 28, 30 that direct the printer ribbon through the print head and back to the take-up spool and an elongated, vertically extending stripper bar 32 that cooperates with the label peeler assembly 16 for partially separating printed labels from their release backing layer as described in more detail below.

The label supply assembly 14 holds and transports a supply of blank labels carried on a release layer to the label printer for printing label information thereon. The label supply assembly includes a label feed spool 34 for holding a roll 36 of blank labels and a take-up spool 38 for holding the release layer after the labels have been removed therefrom. The label take-up spool is driven by a motor controlled by the control assembly 18 as described below. A sensor 40 may be positioned adjacent the label take-up spool for sensing when the roll of release layer carried thereon is of a predetermined diameter so as to alert an operator that a new supply of labels is needed.

Figure 4:
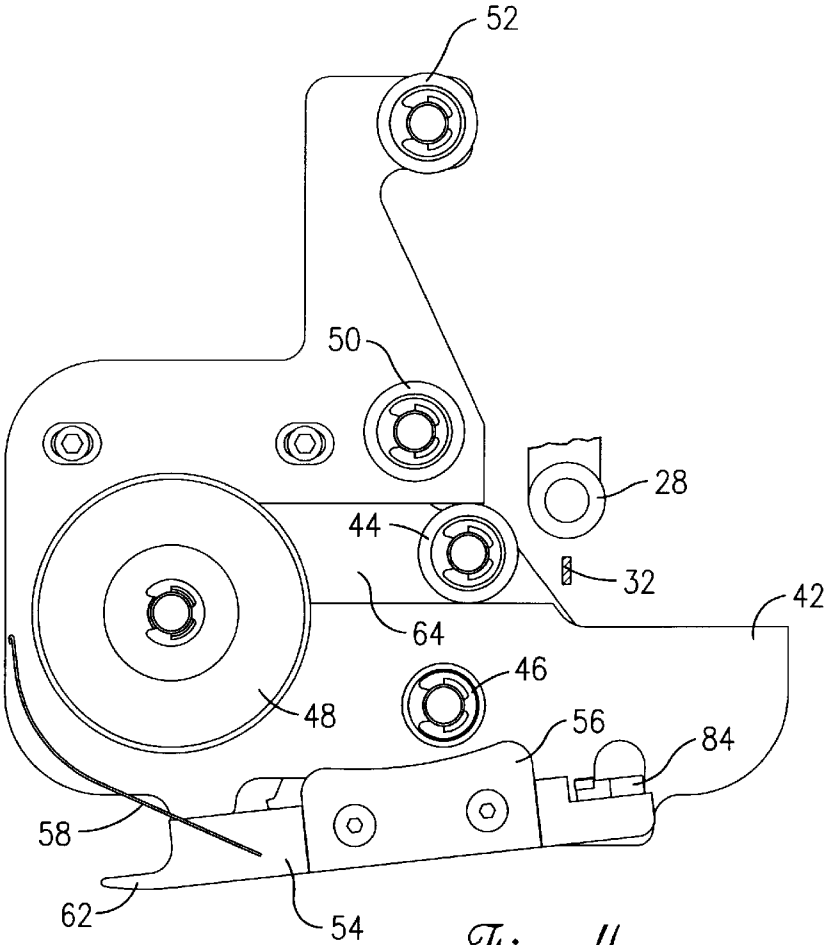
FIG. 4 is a plan view with parts broken away of the label peeler assembly shown in its released, nonoperating position.
Figure 3:
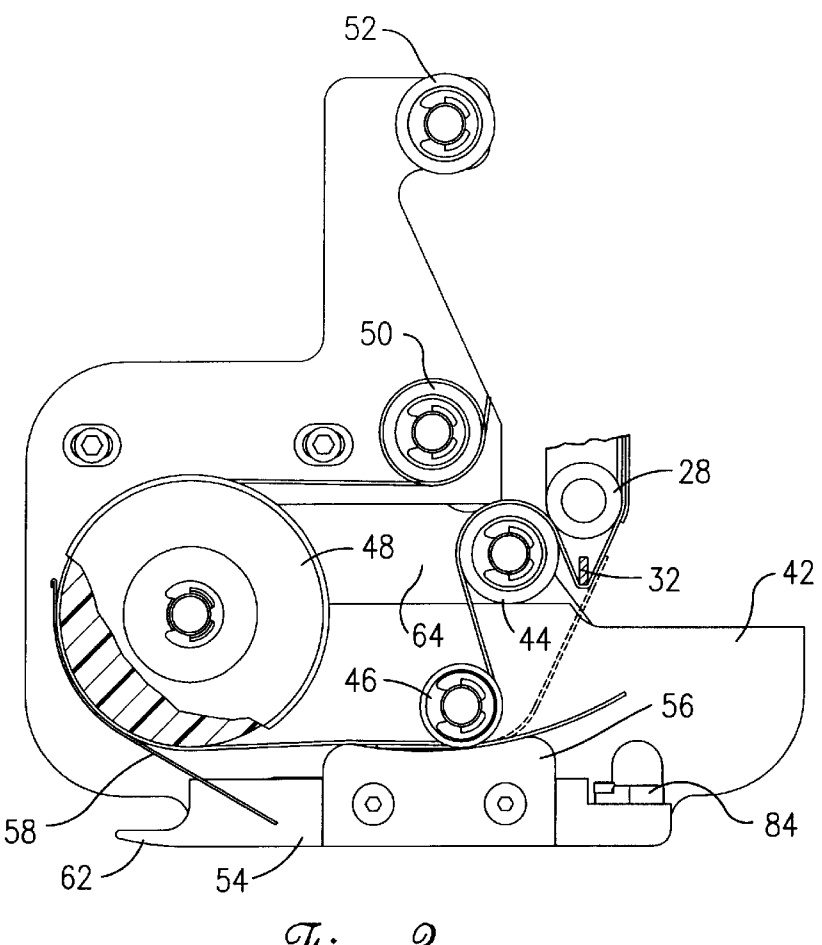
FIG. 3 is a plan view with parts broken away of the label peeler assembly portion of the label printing assembly showing the label peeler assembly in its engaged, operating position.

The label peeler assembly 16 partially separates printed labels from their release layer after the labels exit the label printer 12. The label peeler assembly also cooperates with the control assembly 18 for eliminating mislabeling errors as described in more detail below. As best illustrated in FIGS. 3 and 4, the label peeler assembly includes a base 42 or mounting plate that is mounted on the support plate 19 between the label printer 12 and the label supply assembly 14. A plurality of vertically extending guide rollers 44, 46, 48, 50, 52 are rotatably mounted to the base for directing the printed labels and release layer out of the label printer and for directing the release layer and any wasted labels to the label take-up spool 38.

The roller 44 cooperates with the stripper bar 32 to at least partially separate printed labels from their release layer as best depicted in FIG. 3. Roller 44 is contacting and driven by roller 28 with release layer in between the rollers. Specifically, as a label and its portion of the release layer exit the print head 20, they both are traveling forward relative to the front of the workstation 11. The roller and stripper bar are positioned to redirect the release layer in nearly the opposite direction back toward the label printer at an angle that causes the printed label to separate from its release layer. The roller 44 and the roller 46 then redirect the release layer back toward the front of the label peeler assembly.

A guide arm 54 is attached to the base 42 near the front of the label peeler assembly 16 for guiding the printed labels after they have been partially removed from their release layer. A Teflon label guide 56 is attached to the top of the guide arm so that it is positioned just in front of the roller 46. The surface of the Teflon label guide adjacent the roller is concave shaped. The roller 46 and the concave-shaped surface of the label guide form a nip therebetween that serves to reattach the leading edge of printed labels to their release layer after they have been detached therefrom by the stripper bar 32. The trailing edge of each printed label temporarily remains detached from its release layer so that a pharmacist can easily remove the printed labels from the label printing assembly as described below. An inwardly curved spring guide 58 extends from the end of the guide arm so that it abuts a portion of the roller 48. The spring guide serves to reattach printed labels to their release layer after the labels have been advanced so that the labels can no longer be retrieved as discussed in more detail below.

Figure 5:
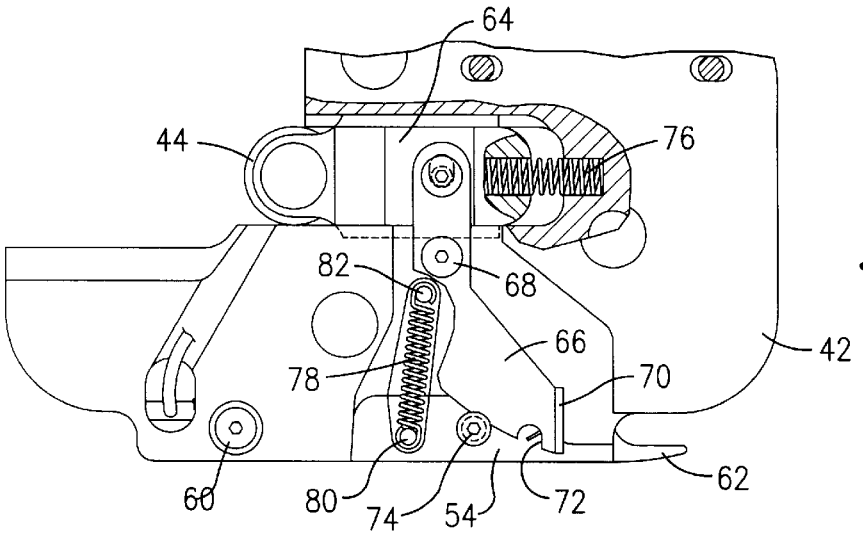
FIG. 5 is a bottom plan view with parts broken away of the label peeler assembly shown in its engaged, operating position.
Figure 6:
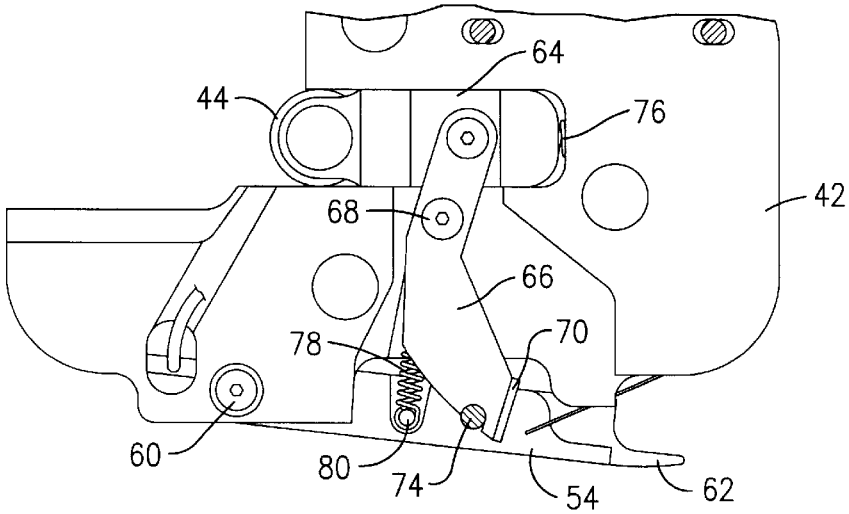
FIG. 6 is a bottom plan view with parts broken away of the label peeler assembly shown in its released, nonoperating position.

The guide arm 54 as well as the roller 44 can be selectively shifted between engaged, operating positions illustrated in FIGS. 3 and 5 and released, non-operating positions illustrated in FIGS. 4 and 6. When in their engaged, operating positions, the guide arm and roller tension the release label and the labels carried thereon so that the label printing assembly can be used to print labels. When in their released, non-operating positions, the guide arm and roller introduce slack into the release layer and labels for maintenance or label reloading purposes.

To accomplish the above-described shifting, one end of the guide arm 54 is pivotally mounted to the base 42 by a pivot mount 60 as best illustrated in FIGS. 5 and 6. The opposite end of the guide arm 54 has a finger tab portion 62 that can be gripped by an operator. The roller 44 is attached to a carrier 64 that is moveable within a channel formed in the base.

A lever 66 illustrated in FIGS. 5 and 6 is provided for shifting the guide arm 54 and the roller carrier 64 between their engaged and released positions. The lever is pivotally mounted to the bottom of the base by a pivot mount 68. One end of the lever includes a tab 70 that can be gripped to operate the lever and a notch 72 that cooperates with a locking pin 74 positioned on the under side of the guide arm as described below. The opposite end of the lever is attached to the underside of the roller carrier.

The guide arm 54 and roller carrier 64 are shifted to their released, non-operating positions by gripping the lever tab 70 and pivoting the lever 66 clockwise as viewed from the orientation of FIGS. 5 and 6. As the lever is shifted clockwise, it pushes the locking pin 74 and the guide arm 54 outward and shifts the roller carrier rightward. When the lever is shifted clockwise to the position illustrated in FIG. 6, the locking pin seats in the notch on the lever for locking the guide arm and the roller carrier in their released positions.

The guide arm 54 and the roller carrier 64 are shifted back to their engaged, operating position by pulling the finger tab 62 on the end of the guide arm outward until the locking pin 74 on the under side of the guide arm is unseated from the notch 72 in the end of the lever. A compression spring 76 positioned between the roller carrier 64 and the base 42 shifts the roller carrier leftward as viewed in FIG. 5, which causes the lever to pivot in a counter clockwise direction once the locking pin 74 unseats from the notch 72. A spring 78 attached between a pin 80 on the under side of the arm and a pin 82 on the under side of the base then biases the guide arm back toward the base into its engaged, operating position.

Figure 7:
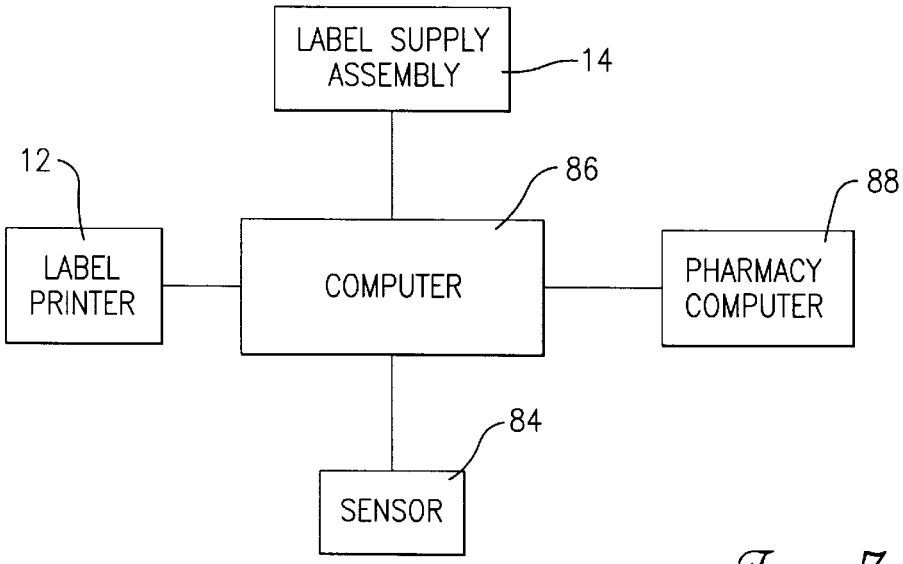
FIG. 7 is a block diagram illustrating certain components of the control assembly portion of the label printing assembly.

The control assembly 18 controls operation of the other components of the label printing assembly and prevents mislabeling errors as described below. As best illustrated in FIG. 7, the control assembly broadly includes a sensor 84 and a computer 86.

The sensor 84 is mounted to the fixed end of the guide arm 54 just forward of the stripper bar 32 as illustrated in FIGS. 3 and 4. The sensor is operable for detecting the presence of a printed label that has been at least partially removed from its release layer and for sending an associated signal to the computer. The sensor may be any type of proximity sensor such as an optical sensor.

The computer 86 monitors the sensor 84 and controls operation of the label printer 12 and the label supply assembly 14. The computer also communicates with a pharmacy host computer 88 (FIG. 7) for retrieving prescription data therefrom as discussed in more detail in the co-pending application entitled Medicament Dispensing Control Workstation referenced above. The computer may be any computing device such as a central processing unit (CPU) of a conventional personal computer or a custom programmed PLC or processor. The pharmacy host computer may be any computer running a pharmacy automation program such as those provided by Zadall Computer Systems.

When the workstation 11 is used as a stand-alone device, it includes its own separate computer that communicates with the pharmacy host computer 88. When the workstation is coupled with an automatic medicament storing and dispensing system, it may not include its own separate computer, but may instead be coupled with the computer running the medicament storing and dispensing system. Such an automatic storing and dispensing system is described in the co-pending patent application entitled Automatic Dispensing System for Unit Medicament Packages referenced above.

In operation, the computer 86 retrieves or is sent data relating to a prescription from the pharmacy host computer 88. A pharmacist or other operator of the workstation 11 then fills and dispenses medicaments in response to the prescription as described in more detail in the co-pending application entitled Medicament Dispensing Control Workstation referenced above. As a part of the prescription filling process, the computer 86 directs the label supply assembly 14 and the label printer 12 to print a prescription label that is to be placed on a vial or package containing the dispensed medicament. As the label is advanced out of the label printer, the label peeler assembly 16 and the stripper bar 32 partially separate the printed label from its release backing layer as depicted in FIG. 3. The label peeler assembly then partially reattaches the leading edge of the printed label to the release layer but allows the trailing edge of the printed label to temporarily remain detached from its release layer so that a pharmacist can easily remove the label from the label printing assembly.

The control assembly 18 also cooperates with the label supply assembly 14 and label peeler assembly 16 to prevent mislabeling errors. Specifically, after a prescription label has been printed and has been at least partially removed from its release layer as illustrated in FIG. 3, the sensor 84 senses the presence of the partially detached printed label and sends a corresponding signal to the computer 86. The computer then begins a countdown and, if the printed label is not removed from the label peeler assembly within a predetermined amount of time after it has been printed, directs the label supply assembly to advance the printed label to the left as viewed in FIG. 3 so that it can no longer be removed from the label printing assembly. This time period may be selected by the operator but is preferably approximately 30 seconds. The computer may display on its monitor a countdown of the time remaining before a label is advanced to alert the pharmacist or operator that a label is about to be wasted.

Similarly, if a pharmacist attempts to fill a new prescription with the workstation 11 before the sensor 84 senses that a printed prescription label for a previous prescription has been retrieved from the label printing assembly, the computer 86 will direct the label supply assembly to advance the older prescription label so that it cannot be retrieved. After a pharmacist attempts to fill a new prescription, the computer may warn the pharmacist to retrieve and apply the label for the previous prescription before the printer advances the old label.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A label printing assembly for use with a medicament dispensing control workstation, the label printing assembly comprising:

a label print head;

a label supply assembly for transporting a supply of blank labels carried on a release layer to the label print head so that the label print head can print label information on the blank labels to create printed labels;

a label peeler assembly operatively coupled with the label print head for at least partially separating the printed labels from the release layer so that an operator of the workstation can remove one of the printed labels from the label printing assembly to be placed on a medicine vial or package; and a control assembly operatively coupled with the label peeler assembly for preventing the operator from retrieving one of the printed labels if the printed label is not removed from the printer assembly within a predetermined amount of time of being printed.

2. The label printing assembly as set forth in claim 1, the control assembly including a sensor coupled with the label peeler assembly for sensing presence of a printed label at the label peeler assembly.

3. The label printing assembly as set forth in claim 2, the control assembly further including a computer operatively coupled with the sensor and the label supply assembly for directing the label supply assembly to advance the printed label away from the label peeler assembly if the printed label has not been removed from the label peeler assembly within a predetermined amount of time.

4. The label printing assembly as set forth in claim 2, the control assembly further including a computer operatively coupled with the sensor and the label supply assembly for directing the label supply assembly to retract the printed label if the sensor determines that the printed label has not been removed before an operator attempts to use the label printing assembly to print another printed label.

5. The label printing assembly as set forth in claim 1, the label supply assembly including a label feed spool for holding the supply of blank labels, a label take-up spool for holding the release layer, and a motor for driving the label take-up spool so as to transport the supply of blank labels from the label feed spool, to the label print head, and by the label peeler assembly.

6. A label printing assembly for use with a medicament dispensing control workstation, the label printing assembly comprising:

a label print head;

a label supply assembly for transporting a supply of blank labels carried on a release layer to the label print head so that the label print head can print label information on the blank labels to create printed labels;

label peeler assembly operatively coupled with the label print head for at least partially separating the printed labels from the release layer so that an operator of the workstation can remove one of the printed labels from the label printing assembly to be placed on a medicine vial or package; and a control assembly operatively coupled with the label peeler assembly for preventing the operator from retrieving one of the printed labels if an operator attempts to use the workstation to print another printed label before the printed label is removed from the printing assembly.

7. The label printing assembly as set forth in claim 6, the control assembly including a sensor coupled with the label peeler assembly for sensing presence of a printed label at the label peeler assembly.

8. The label printing assembly as set forth in claim 7, the control assembly further including a computer operatively coupled with the sensor and the label supply assembly for directing the label supply assembly to advance the printed label away from the label peeler assembly if the printed label has not been removed from the label peeler assembly within a predetermined amount of time.

9. The label printing assembly as set forth in claim 8, the control assembly further including a computer operatively coupled with the sensor and the label supply assembly for directing the label supply assembly to retract the printed label if the sensor determines that the printed label has not been removed before an operator attempts to use the label printing assembly to print another printed label.

10. The label printing assembly as set forth in claim 6, the label supply assembly including a label feed spool for holding the supply of blank labels, a label take-up spool for holding the release layer, and a motor for driving the label take-up spool so as to transport the supply of blank labels from the label feed spool, to the label print head, and by the label peeler assembly.

* * * * *